US010724736B2

(12) United States Patent
Aleysa

(10) Patent No.: US 10,724,736 B2
(45) Date of Patent: Jul. 28, 2020

(54) SMALL HEATING SYSTEM WITH IMPROVED VENTILATION AND CYCLONIC COMBUSTION CHAMBER

(71) Applicant: Fraunhofer-Gesellschaft zur Förderung der angewandten Forschung e.V., Munich (DE)

(72) Inventor: Mohammadshayesh Aleysa, Stuttgart (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 235 days.

(21) Appl. No.: 14/786,450

(22) PCT Filed: Apr. 25, 2014

(86) PCT No.: PCT/EP2014/058521
§ 371 (c)(1),
(2) Date: Oct. 22, 2015

(87) PCT Pub. No.: WO2014/174104
PCT Pub. Date: Oct. 30, 2014

(65) Prior Publication Data

US 2016/0084499 A1 Mar. 24, 2016

(30) Foreign Application Priority Data

Apr. 26, 2013 (DE) ..... 10 2013 207 724

(51) Int. Cl.
*F23G 5/027* (2006.01)
*F23G 5/16* (2006.01)
(Continued)

(52) U.S. Cl.
CPC ..... *F23G 5/027* (2013.01); *F23B 10/02* (2013.01); *F23B 90/06* (2013.01); *F23G 5/16* (2013.01);
(Continued)

(58) Field of Classification Search
None
See application file for complete search history.

(56) References Cited

U.S. PATENT DOCUMENTS 3,457,883 A * 7/1969 Ankersen ..... F23G 5/085 110/210
3,625,186 A * 12/1971 Herbst ..... F22B 31/045 122/448.1
(Continued)

FOREIGN PATENT DOCUMENTS

DE 195 25 106 C1 3/1997
DE 10 2010 021 370 A1 12/2011
(Continued)

OTHER PUBLICATIONS

International Search Report with English translation, dated Oct. 22, 2014, pp. 1-7, issued in International Application No. PCT/EP2014/058521, European Patent Office, Rijswijk, The Netherlands.
(Continued)

*Primary Examiner* — David J Laux
(74) *Attorney, Agent, or Firm* — Brinks Gilson & Lione

(57) ABSTRACT

A small heating system is provided for the combustion of solid fuels, having: a gasification zone for generating combustion gas and a combustion zone for combusting combustion gas; a first blower for supplying primary air into the gasification zone; and a second blower for supplying secondary air into the combustion zone , wherein the first blower can be regulated depending on the desired output of the small heating system and/or the second blower can be
(Continued)

regulated depending on a desired oxygen content in the exhaust air from the combustion zone.

12 Claims, 2 Drawing Sheets

(51) Int. Cl.

| | |
|---|---|
| ***F23B 90/06*** | (2011.01) |
| ***F23G 5/50*** | (2006.01) |
| ***F23B 10/02*** | (2011.01) |
| ***F23N 3/00*** | (2006.01) |

(52) U.S. Cl.
CPC ..... *F23G 5/50* (2013.01); *F23N 3/002* (2013.01); *F23N 2900/05002* (2013.01)

(56) References Cited

U.S. PATENT DOCUMENTS

| | | | | | |
|---|---|---|---|---|---|
| 4,300,460 | A * | 11/1981 | Lamb | F23G 5/165 | 110/190 |
| 4,545,360 | A * | 10/1985 | Smith | F24B 5/026 | 110/315 |
| 4,920,898 | A * | 5/1990 | Solbes | F23C 3/008 | 110/214 |
| 5,054,405 | A * | 10/1991 | Walker | F23G 5/14 | 110/165 A |
| 6,216,610 | B1 * | 4/2001 | Brunnmair | F23G 5/165 | 110/208 |
| 6,336,449 | B1 * | 1/2002 | Drisdelle | F23B 1/36 | 126/73 |
| 2008/0035137 | A1 | 2/2008 | Federico | | |
| 2010/0313797 | A1 * | 12/2010 | Carabin | B09B 3/0025 | 110/235 |
| 2012/0132072 | A1 * | 5/2012 | Baxter | B01D 7/02 | 95/108 |

FOREIGN PATENT DOCUMENTS

| | | | |
|---|---|---|---|
| EP | 0 289 355 | A2 | 11/1988 |
| EP | 2 078 555 | A1 | 7/2009 |
| EP | 2 426 414 | A2 | 3/2012 |
| WO | WO 02/029326 | A1 | 4/2002 |
| WO | WO 2008/068781 | A1 | 6/2008 |

OTHER PUBLICATIONS

Wood Gasification Forum with English machine translation, dated Jan. 16, 2014, pp. 1-38, Holzvergaser-Forum—Thema: Lambdacheck + Pelletkessel. URL: https://web.archive.org.web/20130527133151/http://www/holzvergasser-forum.de/index/php/forum/lambdacheck/8195-lambdacheck-pelletkessel.

Welcome to the Wood Gasification Forum with English machine translation, dated Jan. 16, 2014, pp. 1-5, Holzvergaserforum-Home. Mar. 2012. URL: https://web.archive.org/web/2013031209416/http://holzvergaser-forum.de/.

Wood Gasification: Optimal residual oxygen content, oxygen sensor, FHG Turbo 3000 with English machine translation, pp. 1-2, dated Jan. 16, 2014, URL: http://www.haustechnikdialog.de/Forum/t/55364/Holzvergaser-Optimaler-Restsauerstoffgehalt-Lambdasonde-FHG-3000-turbo.

* cited by examiner

SMALL HEATING SYSTEM WITH IMPROVED VENTILATION AND CYCLONIC COMBUSTION CHAMBER

CROSS-REFERENCE TO RELATED APPLICATIONS

This application is a 371 nationalization of PCT/EP2014/058521, entitled "SMALL FIRING SYSTEM WITH IMPROVED VENTILATION AND CYCLONIC COMBUSTION CHAMBER," having an international filing date of Apr. 25, 2014, the entire contents of which are hereby incorporated by reference, which in turn claims priority to German patent application DE 10 2013 207 724.6 filed on Apr. 26, 2013, entitled "Verbrennungsanlage mit verbesserter Lüftung und zyklonartiger Brennkammer," the entire contents of which are hereby incorporated by reference.

BACKGROUND

The application relates to an improved small heating system.

A method and a device for burning solid fuels are known from EP 2 426 414 A2. Here a device is used that has a combustion chamber in which primary combustion is carried out on a feed grate. Above the combustion chamber a cyclone chamber is arranged, in which cyclone combustion is performed. In the cyclone chamber, a rotary movement of the smoke gases and the solids contained therein is effected, whereby the solids are forced outward and, if necessary, if they do not burn in the cyclone combustion, are guided partly directly and partly via lines back into the combustion chamber and serve for dust separation. Toward this end, the fly ash is tangentially drawn from the combustion chamber and transported directly into the primary combustion chamber, under the grate or via separate ash logistics.

An arrangement of small heating systems for achieving a desired oxygen content is known from the Wood Gasification Forum—Topic: Lambda Check+Pellet Boilers URL: http://www.holzvergaser-forum.de/index.php/forum/lambdacheck/8195-lambdacheck—pelletkessel and Wood Gasification Forum—Flome. March 2012 URL:https://web.archive.org/web/20130312090416/http:/holzvergaser-forum.de/ as well as Haustechnik-Dialog—Wood Gasification: Optimal residual oxygen content, lambda sensor, FHG 3000 turbo. URL: http://www.haustechnikdialog.de/Forum/t/55364/Holzvergaser-Optimaler-Restsauerstoffgehalt-Lambdasonde-FHG-3000-turbo [all accessed at Jan. 16, 2014].

Separate optimization of the primary and secondary air supply is known from the aforementioned source Holzvergaserforum—Home, March 2012. URL: https://web.archive.org/web/20130312090416/http:I/holzvergaser-forum.de/.

A method and device for combustion of organic material are known from EP 0 289 355 A2, in which a gas and air are guided into a combustion chamber. The combustion chamber has a surface formed by rotation about a longitudinal axis.

A large heating system for solid combustible material is known from DE 195 25 106 C1, with a feed grate for continuously rearranging and guiding the combustible material through different zones.

DETAILED DESCRIPTION

Figure 1:
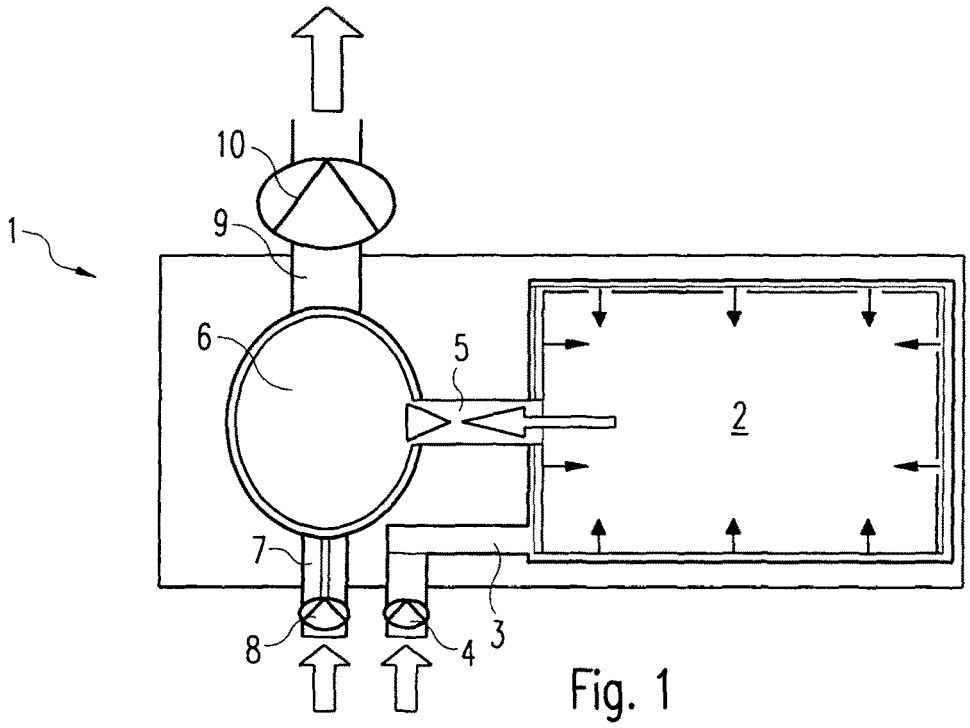
FIG. 1 shows a systematic design of a small heating system.

Small household heating systems are a major source of emission pollution for particulate matter and gaseous pollutants. It is also problematic here that this emission pollution occurs in residential areas. The object of the invention is therefore to provide small heating systems, which have limited equipment expense and reduced pollution.

It has been recognized that a small heating system for the combustion of solid fuels with a gasification zone for the production of fuel gas and a combustion zone for the combustion of fuel gas must be provided. In this case, a first blower for feeding primary air into the gasification zone and a second blower for supplying secondary air into the combustion zone must be provided. In this case, the first blower is controllable depending on the desired performance of the small heating system and/or the second blower is controllable depending on the desired oxygen content in the exhaust air from the combustion zone.

In previous systems of this type that have a gasification zone and a combustion zone, an induced draft blower in the exhaust from the combustion zone is common, but not two separate blowers. The division of the primary air and the secondary occurs by means of motor-driven or manually operated valves. This only allows an insufficiently dosed air supply. This will be illustrated in more detail by the following example: In the gasification process, solid fuel can fall in the gasification zone. This is generally true for solid fuels. Important examples include firewood and briquettes. Thus the flow resistance changes in the gasification zone. The result may be that in the case of diminishing flow resistance too little air is guided into the gasification zone and too much air into the combustion zone. The resulting excess air in the combustion zone leads to a decrease in the combustion temperature, thereby degrading the combustion, and both CO levels as well as fine dust values rise. This is exacerbated by the fact that the lowered air supply to the gasification zone decreases the production of fuel gas. This also contributes to an excess of air and to the aforementioned problems.

The small heating systems described here are gasification boilers, i.e. systems in which solid fuel is first gasified to provide fuel gas and the fuel gas is subsequently burned. According to the statutory regulations valid in Germany at the time of application, up to a capacity of 1 MW, combustion systems are considered to be small heating systems. Normally the power is about 100 kW to 200 kW, but systems with a power of about 400 kW are still common.

For the sake of completeness it should be mentioned that the primary air and the secondary air are usually ambient air from outside. Preheating of the primary air and secondary air is usually a good idea and can be carried about by heat transfer from exhaust air in a heat exchanger.

The above-described design allows an easy remedy and leads to a noticeable reduction in emission pollution. As regards the desired oxygen content, it should be mentioned that favorable oxygen content must be selected, which allows combustion with the least emissions possible, and at the same time provides high efficiency. The desired oxygen content is an empirical value, which results mainly from the efficiency and a desired low CO content in the exhaust gas. The CO content is a good indicator of combustion quality.

Other parameters for controlling the air supply into the combustion zone are also feasible. One must consider the temperature in the exhaust gas and/or the temperature in the combustion zone. It is feasible to detect the temperature at different points of the combustion zone. Even the $CO_e$ content in the exhaust gas case can be used. The $Co_e$ content is the sum of CO, $CH_4$. and other incompletely burned carbon-containing combustion products.

In one embodiment it is provided that the desired oxygen content is from 4% to 6%. The details have to do with volume percent, the percentage of oxygen flow rate of the total volume flow. The desired oxygen content depends on the design of the small heating system.

One embodiment of the invention includes an induced draft blower to improve exhaust flow. It should be noted here that the purpose of the induced draft blower is not to take over regulation of the air supply to the combustion zone and/or gasification zone. As shown, this is taken over by the first blower and the second blower and the associated control parameters. However, the induced draft blower can indirectly influence control of the first and second blower, as especially the second blower can deliver the same flow rate with lower power when the induced draft blower is operating. The induced draft blower here is usually regulated such that a desired vacuum is maintained in the exhaust passage.

In one embodiment, the combustion zone is designed in several stages, wherein in particular a main combustion stage and a post-combustion stage are present. This can be realized in the form of a multilevel combustion chamber, in which the different combustion stages are arranged one above the other.

An important embodiment of the invention, but one which is also important independently of the invention described above, with two separate blowers for the primary air and secondary air, provides for a main combustion chamber in the form of a cyclone as the main combustion stage. Cyclone chambers are known for dust removal, as well as for post-combustion. In small heating systems of the type described here, however, it is not known to provide a combustion chamber in the form of a cyclone. Such a combustion chamber allows good mixing of air and fuel gas and thus good combustion, so that the combustion chamber can serve both as a main combustion stage and at the same time as a post-combustion stage, whereby one component can be omitted. The combustion chamber in the form of a cyclone normally has to withstand high temperatures of up to 1400° C. Therefore the combustion chambers are usually built of stone, but other materials that can withstand high temperatures can be considered. The well-known cyclones for dust removal are normally made of metal and would usually not withstand the operation temperatures of a combustion chamber. If there is good combustion control and an appropriate combustion chamber in the form of a cyclone, often the post-treatment step can be skipped.

In one embodiment of the combustion chamber in the form of a cyclone, an immersion tube is present, so that sufficient mixing of fuel gas and secondary air and a sufficient dwell time of the combustion gas in the combustion chamber in the form of a cyclone are forced. For better understanding, here is a brief illustration of function in an example: The cyclone has a circular cross section which tapers towards the bottom. The immersion tube extends from above into the combustion chamber and is arranged centrally. The fuel gas and the air, or more precisely the secondary air, are blown laterally into the combustion chamber from above. Here, flow around the axis of the combustion chamber is forced along the wall of the combustion chamber. The flow also receives a component of downward motion, so that the fuel gas and the secondary air flows downward along a helical line. In this case, there is good mixing of fuel gas and secondary air. Since the gas mixture has to flow at least to the lower end of the immersion tube, in order to be able to flow out as up to that point combusted exhaust gas, a so-called short flow is prevented, in which the inflowing gas, over a short path largely without detours, again leaves the combustion chamber. This hazard would otherwise exist, particularly at low fuel gas flow rates, which occur at low powers. A combustion chamber in the form of a cyclone, especially embodiments with an immersion tube, therefore has particular advantages when operating in the low power range.

In one embodiment, a tertiary air feed into the combustion zone is also possible. In this way the combustion can be further improved. The tertiary air is normally only fed after the combustion gas and secondary air have traveled a certain distance in the combustion chamber. By that point the oxygen content may well have dropped due to combustion, so that a supply of tertiary air improves combustion. The tertiary air can be diverted from the secondary air, but it is also possible to provide a separate blower for the tertiary air. Usually it makes sense to use preheated secondary air and tertiary air, in order to avoid cooling at the feed area and associated poorer combustion.

In one embodiment a post-treatment step is present, This can be a thermal or a catalytic process. In a thermal post-treatment stage, carbon black is deposited at low temperatures, which is burned off again at high temperatures. Thus the amount of unburned carbon black that would be emitted at low temperatures is reduced. The same thing is achieved with a catalytic post-treatment step. In this case a catalyst ensures that incompletely burned carbon black is burned even at lower temperatures.

In one embodiment, the post-treatment stage is formed by a permeable structure with a high surface, whereby preferably ceramic components are used. Since in both the thermal operation and in the catalytic operation, the surface plays a decisive role, a large surface area makes sense.

In one embodiment of the invention it is provided that a lateral fuel gas feed, which is intended to deliver fuel gas and secondary air into the combustion chamber in the form of a cyclone, is designed as a Venturi channel. This results in better mixing of the fuel gas and secondary air.

In one embodiment of the invention it is envisaged that the immersion tube as is designed as a Venturi channel. This allows better mixing of the flow in the immersion tube. In particular, tertiary air, which is often blown into the immersion tube, can be better mixed with the exhaust gas, whereby improved post-combustion can take place can take place in the immersion tube.

Further details will be described below with reference to the figures.

In FIG. 1 a small heating system 1 can be seen. In the marked area, a gasification zone 2 is shown. Through a primary air supply line 3, the primary air goes into the gasification zone 2. As indicated by the arrows, the primary air flows from different sides into the gasification zone. This is affected by a first blower 4. The first blower 4 here is controlled depending on the desired performance of the small heating system 1. In the gasification zone 2, low-temperature carbonization gas is produced in a conventional manner by means of pyrolysis from the primary air and the fuel that is used, frequently firewood, and serves as the fuel gas.

The fuel gas flows through a distribution system 5 into a combustion zone 6. The mass flow of fuel gas flowing through the distribution system 5 is decisively influenced by the primary air supply and thus by proper operation of the first blower 4.

The combustion zone 6 has a supply line 7, in which a second blower 8 is located for feeding the secondary air. The second blower simultaneously serves to supply tertiary air, as will be explained in more detail below. The exhaust formed in combustion flows into an exhaust duct 9. This is significantly supported by an induced draft blower 10, which is controlled such that a desired vacuum is formed in the exhaust duct 9, so that the exhaust gas flows from the combustion zone 6 into the exhaust duct 9.

Figure 2:
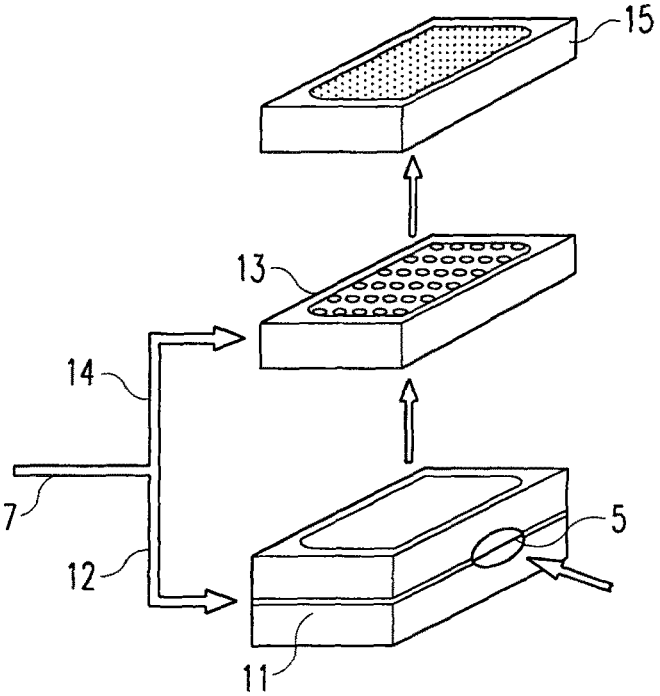
FIG. 2 is an illustration of a multilevel combustion chamber.

FIG. 2 shows the combustion zone 6 in more detail. Here a multilevel combustion chamber is used. A main combustion stage is shown at the bottom. On the right is the distribution system 5, through which the fuel gas passes into the main combustion stage 11. The secondary air and the tertiary air are delivered through the supply line 7 on the left. For preheating the secondary air and the tertiary air, the channel 7 runs in a manner not shown here, on the combustion chamber, which encloses the combustion zone 6 or on a gasification chamber enclosing the gasification zone 2. By preheating the secondary air, combustion is markedly improved by a slight cooling of the reaction zones and a better mixing of the combustion air with the fuel gas. The secondary air passes through a secondary air line 12 into the main combustion stage 1. This purpose is served by a number of nozzles arranged in different planes in the interior walls of the chamber enclosing the main combustion stage 11. Combustion substantially occurs in the main combustion stage 11. The exhaust leaving the main combustion stage 11 still contains a significant amount of unburned components. Further combustion takes place in a post-combustion stage 13. In order to allow this to run optimally, tertiary air is supplied via a tertiary air line 14. Secondary air and tertiary air differ only in the area in the combustion zone to which they are delivered.

The post-combustion stage 13 is a compactly constructed module that is divided into several sectors. In each sector there is a turbulator for intensifying mixing with the tertiary air and separation of dust particles, which can block the porous structure. Thanks to the compact design of the post-combustion stage 3, less heat loss can occur. In this way the oxidizable components of the exhaust as will remain in the effective reaction zone longer and thus better oxidation is ensured. The turbulators are cleaned manually with a lever or automatically by a vibrator to remove the separated dust.

The exhaust gas leaves the post-combustion stage 13 and passes into a post-treatment stage 15. The post-treatment stage 15 is a three-dimensional porous structure, which comprises loose materials and depending on the material and operating phase, in other words existing conditions, functions thermally and/or catalytically. The post-treatment stage 15 provides both for the further treatment of hard-to-oxidize components, which can pass through the main combustion stage 11 and the post-combustion stage 13, as well separation and collection of organic particles such as carbon black in the operating phases, in which the temperature for complete oxidation is not sufficient. These particles are subsequently completely oxidized when a favorable temperature is reached, and in this way the structure is regenerated without additional energy. A particular advantage of the post-treatment stage 15 is that the hot structure can provide the activation energy for the reaction, as for example, in the burn-out phase. In addition, the inorganic fine dusts in this structure can be filtered by various effects such as blocking, sedimentation, and diffusion. This causes a pressure loss increase. Therefore the structure must from time to time be cleaned of inorganic dusts by mechanical shaking. Shaking can be done manually or automatically by a vibrator.

Figure 3:
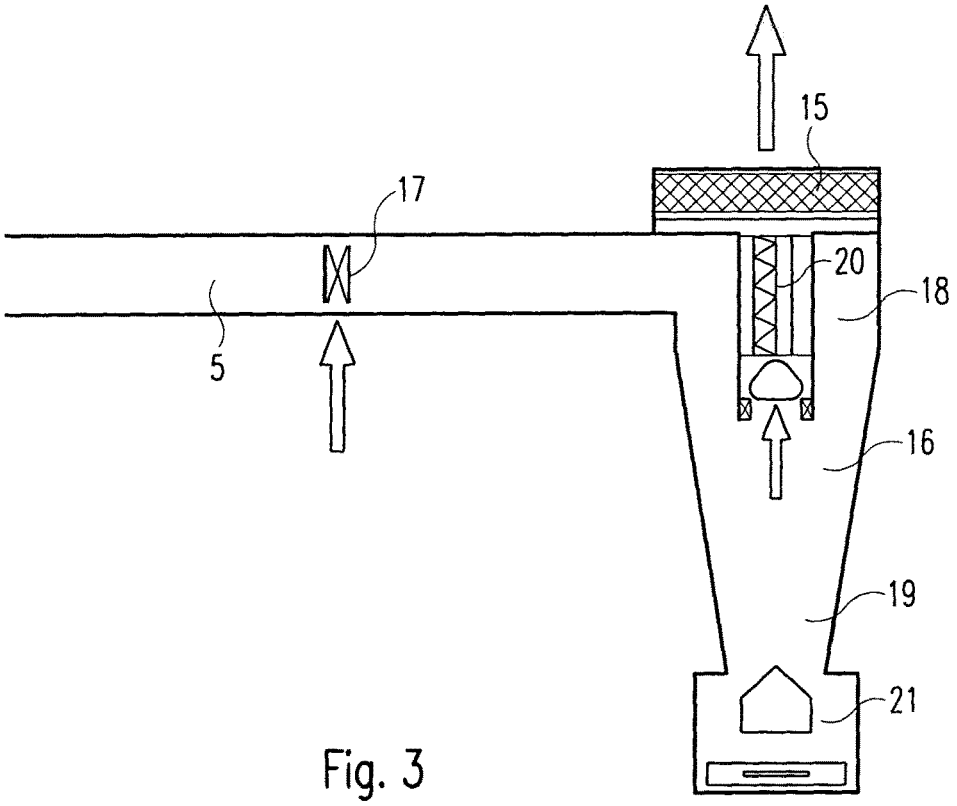
FIG. 3 shows a combustion chamber in the for a of a cyclone.

Instead of the main combustion stage 11 and the post-combustion stage 13, a combustion chamber 16, shown in FIG. 3 in the form of a cyclone, can be used. The combustion gas coming from the gasification zone 2, not shown, is guided through the distribution system 5 to the combustion chamber 16. Heated secondary air is added in a mixing region 17. The mixture of secondary air and fuel gas flows from the side into the upper region 18 of the combustion chamber 16. This effects circulation of the mixture along with further mixing. The mixture flows as it were in a helical line further downward in the tapered combustion chamber 16 to a lower region 19 of the combustion chamber 16. Combustion substantially occurs in the lower region 19, so that this corresponds to the main combustion stage. From the lower region 19 the exhaust st produced in combustion flows into an immersion tube 20, which is immersed from above into the combustion chamber, In the immersion tube 20, further combustion occurs, corresponding to that of the post-combustion stage with the addition of preheated tertiary air. The exhaust gas flows from there into the post-treatment stage 15, which if there is good combustion in the combustion chamber 16 often can be dispensed with.

Due to rotary flow in the combustion chamber 16, solid components are thrown outward and fall into the ash box 21.

Figure 4:
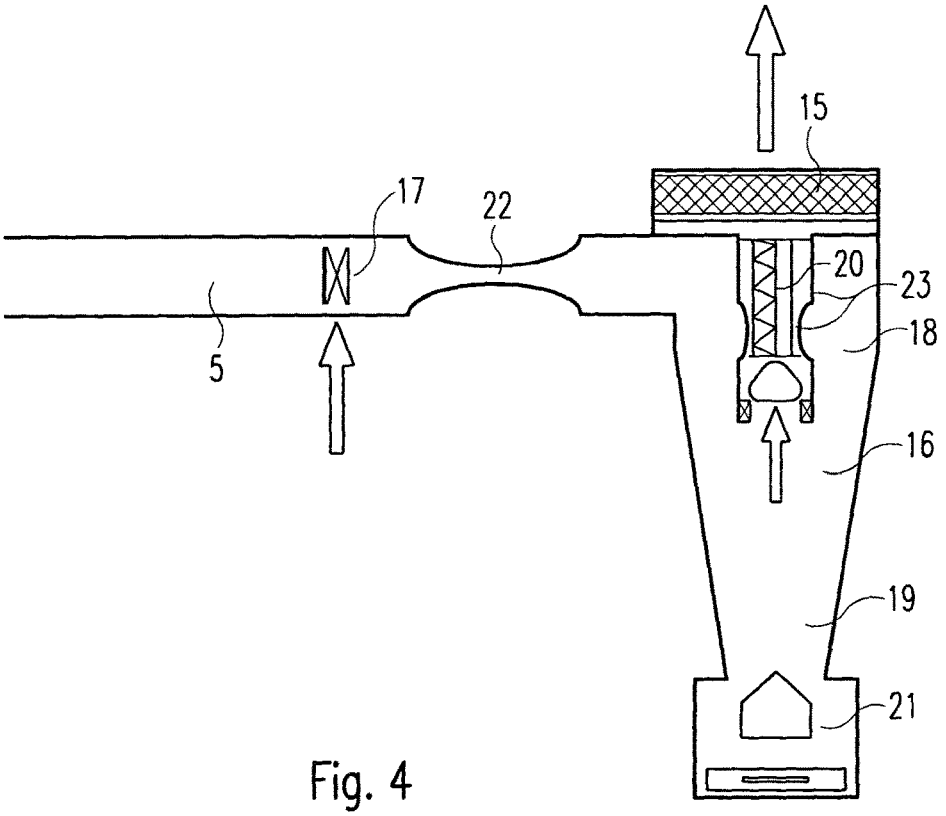
FIG. 4 is a combustion chamber in the form of a cyclone with Venturi channels

The combustion chamber 16 shown in FIG. 4 differs from the combustion chamber shown in FIG. 3 in that, for improved flow control, the distribution system 5 downstream of the mixing region 17 is designed as a Venturi channel 22. Likewise the immersion tube 20 is designed as a Venturi channel 23.

LIST OF REFERENCE NUMBERS

1 small firing
2 gasification zone
3 primary air supply line
4 first blower; primary air blower
5 distribution system
6 combustion zone
7 supply line for secondary air and tertiary air
8 second blower
9 exhaust duct
10 induced draft blower
11 main combustion stage
12 secondary air line
13 post-combustion stage
14 tertiary air line
15 post-treatment stage
16 combustion chamber in the form of a cyclone
17 mixing region
18 upper region of the combustion chamber 16
19 lower region of the combustion chamber 16
20 immersion tube
21 ash box
22 Venturi channel in the fuel gas supply
23 Venturi channel in the immersion tube 20

The invention claimed is:

1. A household heating system for combustion of a solid fuel, the heating system comprising:

a gasification zone for production of fuel gas from the solid fuel;

a combustion zone for combustion of fuel gas;

a first blower for feeding primary air into the gasification zone;

a second blower for feeding secondary air into the combustion zone, wherein the first blower is controllable depending on a detected temperature in exhaust of the combustion zone and/or in the combustion zone, and the second blower is controllable depending on a sensed oxygen content in the exhaust of the combustion zone; and a third blower controllable to cause exhaust gas to flow from the combustion zone into an exhaust duct and maintain a desired vacuum in the exhaust duct.

2. The household heating system according to claim 1, wherein the sensed oxygen content in the exhaust of the combustion zone is between 4% and 6% depending on the design of the household heating system.

3. The household heating system according to claim 1, wherein the third blower is an induced draft blower configured to improve exhaust transport.

4. The household heating system according to claim 1, wherein the combustion zone is configured in multiple stages.

5. The household heating system according to claim 4, wherein the multiple stages comprise a main combustion stage and a post-combustion stage.

6. The household heating system according to claim 1, further comprising a combustion chamber in the form of a cyclone, the combustion chamber is a main combustion stage.

7. The household heating system according to claim 6, wherein an immersion tube is included in the combustion chamber in the form of a cyclone, so that sufficient mixing of the fuel gas and secondary air and an adequate dwell time of the fuel gas in the combustion chamber are forced in the combustion chamber in the form of a cyclone.

8. The household heating system according to claim 7, wherein the immersion tube is configured as a Venturi channel.

9. The household heating system according to claim 6, further comprising a lateral fuel gas feed is configured as a Venturi channel.

10. The household heating system according to claim 1, wherein delivery of tertiary air to the combustion zone is possible.

11. The household heating system according to claim 1, further comprising a post-treatment stage.

12. The household heating system according to claim 11, wherein the post-treatment stage comprises a permeable structure including ceramic components.

* * * * *